United States Patent [19]

Pierce, Jr.

[11] 4,080,886

[45] Mar. 28, 1978

[54] AUTOMATIC CLUTCH LOCK OUT MECHANISM FOR PACKAGE TYING MACHINE

[75] Inventor: Paul Pierce, Jr., La Grange, Ill.

[73] Assignee: B. H. Bunn Company, Alsip, Ill.

[21] Appl. No.: 774,420

[22] Filed: Mar. 4, 1977

[51] Int. Cl.[2] ..... B65B 13/18

[52] U.S. Cl. ..... 100/4; 100/27

[58] Field of Search ..... 100/4, 17, 27

[56] References Cited

U.S. PATENT DOCUMENTS

| | | | |
|---|---|---|---|
| 1,201,688 | 10/1916 | Bunn | 100/4 |
| 1,606,290 | 11/1926 | Bunn | 100/27 X |
| 2,361,742 | 10/1944 | Bunn | 100/17 |
| 2,898,847 | 8/1959 | Bunn | 100/4 |

*Primary Examiner*—Billy J. Wilhite

[57] ABSTRACT

An automatic clutch lock out and clutch release mechanism for package tying machines of the type utilizing handles or foot pedals to initiate a machine cycle. The automatic clutch lock out mechanism includes a cam gear rotatably mounted atop the forked clutch lever and a wedge-shaped release rack lever controllably operated by the tying machine's foot pedal or handle and which both meshes with the cam gear and slidably engages the associated cam follower lever, the combination of the two effecting gradual, quiet, and smooth engagement of the machine's clutch at the beginning of a tying cycle and further providing a safe and inexpensive clutch lock out that eliminates unreliable electrical components.

11 Claims, 6 Drawing Figures

AUTOMATIC CLUTCH LOCK OUT MECHANISM FOR PACKAGE TYING MACHINE

BACKGROUND OF THE INVENTION

1. Field of the Invention

This invention relates to package tying machines, and more particularly to clutch lock out and clutch release mechanisms for such machines.

2. Description of the Prior Art

The interest in the safety and overall working environment of the operator of package tying machines has motivated tying machine manufacturers to incorporate specialized clutch lock out mechanisms in such machines. That is, mechanical or electrical safety devices are incorporated in tying machines to prohibit any inadvertent operation such as can happen when a machine has been turned off and the cycle-initiating hand lever or foot pedal is inadvertently tripped thereby causing the machine to undesirably cycle without notice when the machine is again turned on. Various electrical lock out systems have been utilized on prior art package tying machines, but these have been found undesirable as being either unduly expensive or unreliable because of the occasional failure of associated electrical components.

Additionally, there has been a continuing desire to eliminate as much operating noise as possible from package tying machines, especially in those instances where multiple tying machines are in tandem and kept continually running, such as in high volume, package-shipping operations. When the clutch is engaged in many prior art machines, various sharp reports are produced such as when the clutch plate members snap together and when the associated clutch-engaging components change positions.

Reference is made to U.S. Letters Pat. Nos. 1,201,688; 2,361,742; and 2,898,847 wherein the structure and operation of typical prior art clutch-engaging mechanisms for tying machines are described. Reference is also made to U.S. Letters Pat. Nos. 1,606,290 and 2,898,847 wherein the operation of typical prior art package tying machines are described. Generally, the prior art machines included a wedge-shaped release lever — connected to the machine's cycle-initiating foot pedal or hand lever — that was instantly removed from between the machine's clutch operating lever (forked clutch lever) and the cam follower lever thereby causing the clutch to become engaged, but at the same time causing both undesirably loud, mechanical noises and the possibility of self-releasing of the cam, while providing no effective clutch lock out control. Additionally, the prior art clutch release mechanisms provided no simple adjustment when associated clutch parts become worn with use.

SUMMARY OF THE INVENTION

The present invention concerns an automatic clutch lock out and clutch release mechanism for a package tying machine of the type having hand lever or foot pedal initiation. It comprises a cam gear rotatably connected in an eccentric manner to the forked actuating lever of a tying machine's clutch and a release rack lever in the form of a wedge-shaped rack gear meshed with the cam gear. The release rack lever is operable — when once displaced by foot pedal initiation of the tying machine — to rotate the cam gear and thereby reduce the effective distance between the associated cam follower lever and forked clutch lever and thereby allow the clutch plates to be eased into engagement. This is done in a smooth, gradual, and quiet manner due to the eccentric operating mode of the cam gear and the wedge shape of the release rack lever. Further, the mechanical advantage provided by the combination of the relative actions of the rotatable cam gear and the release rack lever, which is under the bias of associated return springs, assures that the release rack lever is always inserted between the forked actuating lever and the clutch lever so as to at least partially separate the same. The result then is even if the foot pedal (or hand lever) is inadvertently or otherwise tripped when the machine is shut off, the machine will not automatically cycle when again turned on because the partial separation of the cam follower lever and forked clutch lever — due to the constant insertion of the release rack lever therebetween — is sufficient to maintain the clutch members in a disengaged condition.

The automatic clutch lock out and release mechanism of the present invention eliminates the need for the rather costly electrical components found in electrical clutch lock out mechanisms of the prior art, and further eliminates breakdowns due to the unreliable nature of such electrical components. In contrast, since the present invention's principal components comprise a wedge-shaped rack gear and a cam gear, simple adjustment can be made to take up slack within limits in the machine's clutch components as they wear with use.

A rather significant advantage of the present invention is the fact that the substantial noises produced at the initiation of a cycle in prior art tying machines are eliminated thereby enhancing the overall working environment of the machine's operator. Such noise reduction is due to the fact that the components of the present invention effect gradual, smooth, and quiet engagement of the tying machine's clutch components.

Accordingly, it is a principal object of this invention to provide a smooth and gradual clutch release mechanism that additionally operates as an effective and automatic clutch lock out mechanism.

It is another object of this invention to reduce the operating noise levels of the clutch members in package tying machines.

It is still another object of this invention to provide an automatic clutch lock out and clutch release mechanism that can be adjusted to accommodate for wear in the associated clutch members.

It is a further object of this invention to provide an automatic clutch lock out mechanism that is inexpensive and reliable.

It is still a further object of this invention to provide a clutch release mechanism that prevents self-releasing of the tying machine's clutch.

The means by which the foregoing and other objects of the present invention are accomplished and the manner of their accomplishment will be readily understood from the following specification upon reference to the accompanying drawings in which.

DESCRIPTION OF THE PREFERRED EMBODIMENT

Figure 1:
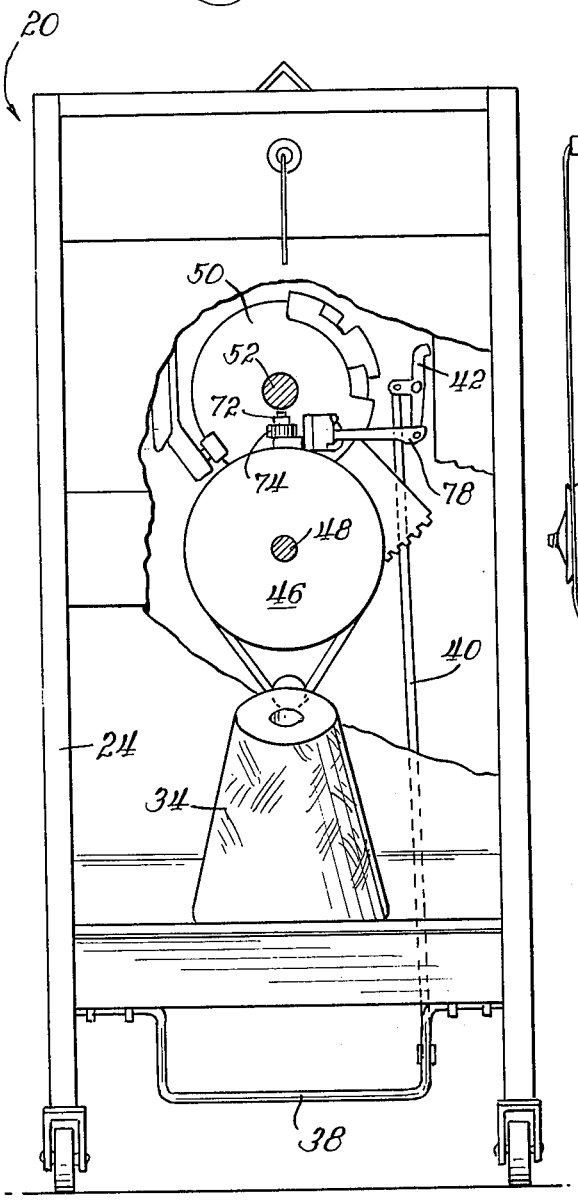
FIG. 1 is a partially-fragmented front elevational view of a typical package tying machine within which the present invention can be utilized.
Figure 2:
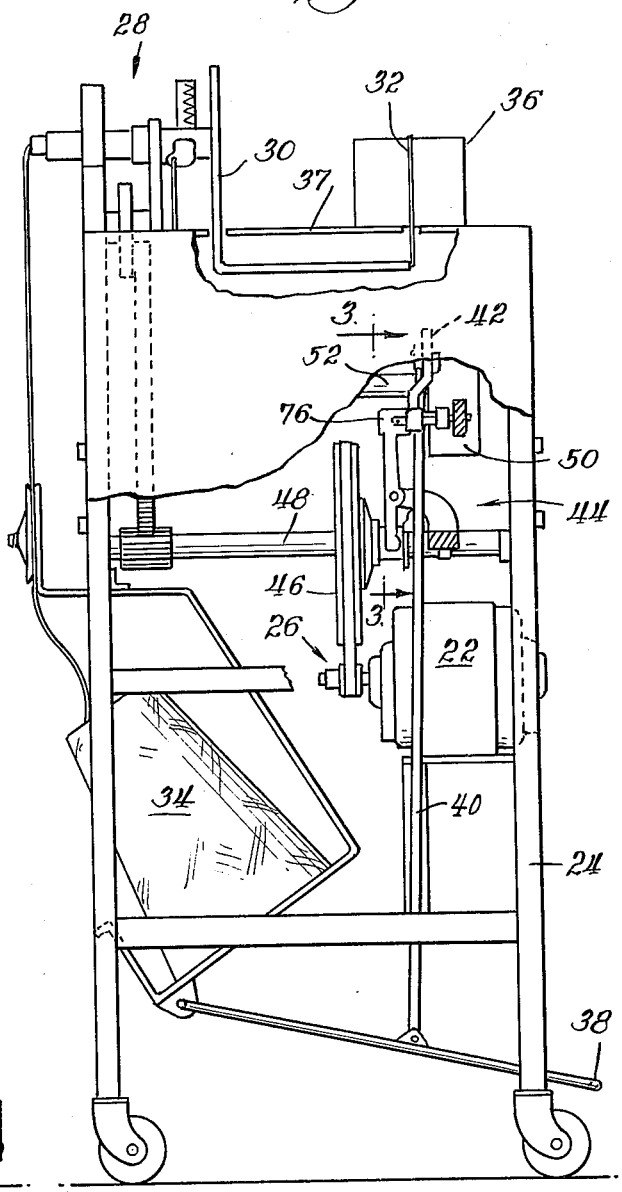
FIG. 2 is a partially-fragmented side elevational view of the package tying machine of FIG. 1.

Having reference to the drawings, wherein like reference numerals indicate corresponding elements, there is shown in FIGS. 1 & 2 an illustration of a package tying machine generally denoted by reference numeral 20. Although a more detailed explanation of the structure and operation of the basic components of a package tying machine is found in the above-referenced U.S. Letters Patent, for purposes of the present invention it is sufficient to explain that a motor 22, mounted on a frame 24 is operable through a pulley and belt drive assembly 26 and a gear and chain drive assembly 28 to drive a twine arm 30 which when rotated will wrap one or more reaches of twine 32 from a twine supply 34 about a package 36 resting on a table top member 37. A knotter mechanism (not shown) then knots and severs the ends of the wrapped twine and the tied package can be removed from the machine and the tying cycle repeated with a new package.

After the motor 22 has been electrically energized, initiation of a tying cycle is accomplished by depression of an operator's foot pedal 38 mounted on frame 24 which is, through a connecting rod or trip bar 40 and a bell crank 42 (also mounted on frame 24), connected to a clutch operating assembly 44, which will be described in detail later herein. It will be understood by those skilled in the art that the foot pedal 38 and trip bar 40 can be replaced by an equivalent hand-operated mechanism (not shown) to actuate the clutch operating assembly 44.

A main pulley 46 is rotatably journalled on a primary shaft 48, and a rotatable face cam 50 which drives the knotter mechanism directly or through chains and sprockets (neither shown) is rigidly mounted on a secondary shaft 52. As will become obvious later herein, once the clutch components of the tying machine 20 are engaged, the pulley drive assembly 26 drives shaft 48 which in turn — through the gear drive assembly 28 — drives the shaft 52 and the face cam 50 in timed relation.

Figure 3:
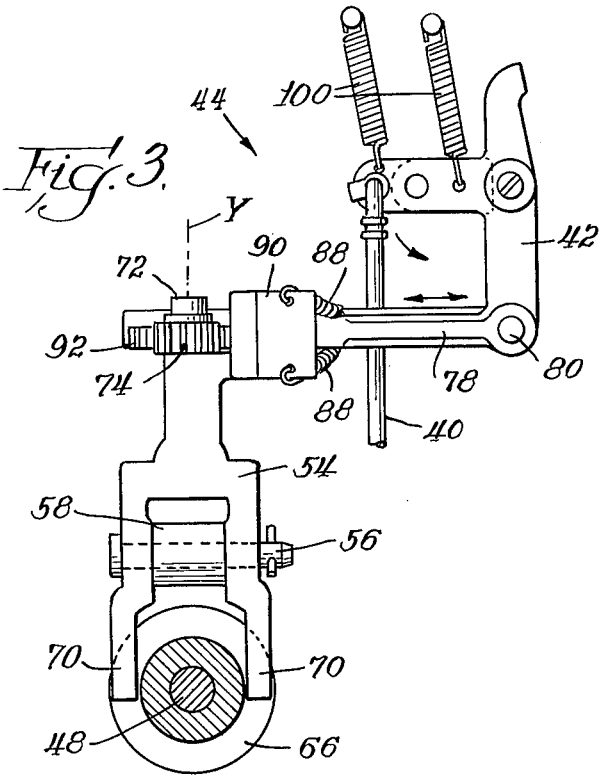
FIG. 3 is an enlarged and fragmented front elevational view of the clutch portion of the tying machine of FIG. 1 taken along line 3—3 thereof.
Figure 6:
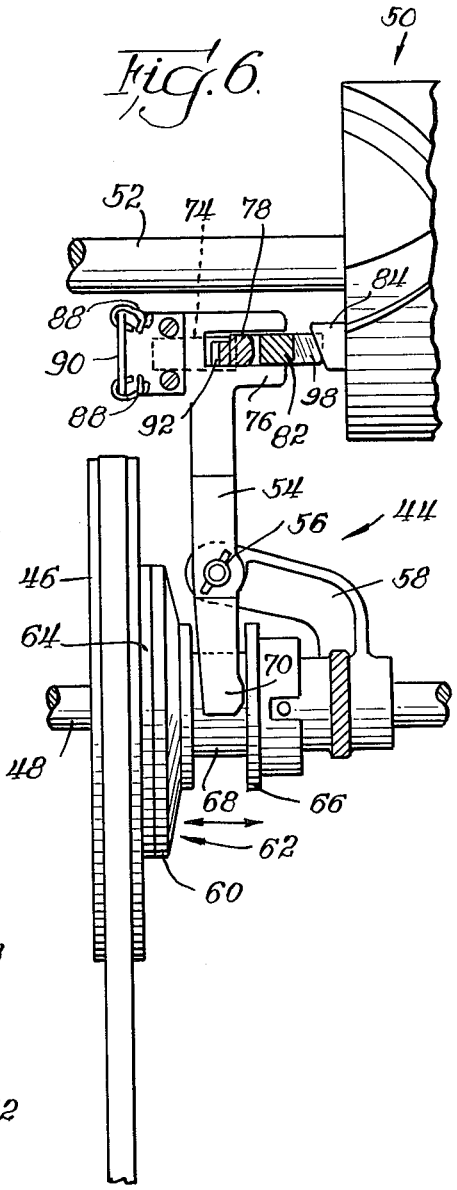
FIG. 6 is an enlarged side elevational view of the clutch portion of the tying machine of FIG. 1 with some components shown in section.

Turning now to a description of the structure and operation of the clutch operating assembly 44 of the present invention, there is depicted in FIGS. 3 & 6 a forked clutch operating lever 54 mounted for pivotal movements through pin 56 to a support bracket 58, the latter being secured to frame 24. A plate 60 of a clutch 62 is linearly movable toward and from a coacting clutch plate 64 (along the double-headed arrow in FIG. 6), and the movements thereof are controlled, in part, through an attached collar 66 which is grooved at 68 to receive the forked end 70 of clutch lever 54.

Figure 4:
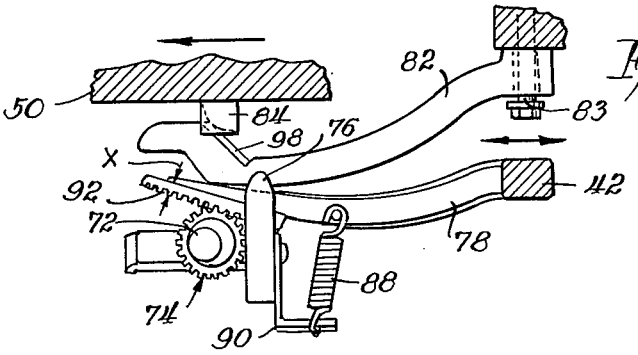
FIG. 4 is an enlarged and fragmented plan view of the clutch portion of the tying machine of FIG. 1 and depicting one of its various operational positions.

The opposite end 72 of clutch lever 54 has a cam gear 74 rotatably secured in offset or eccentric fashion thereto, and a forked guide 76 which extends therefrom adjacent the roller. As best seen in FIGS. 1, 4 & 6, rotatable cam gear 74 rotates about an axis Y (FIG. 3) which is at right angles to the axis of the shaft 48 and is disposed in proximity to the face cam 50.

As noted above, the clutch operating assembly 44 used in connection with the present invention is of the type that is manually actuated for initiating a tying cycle and, as will be explained more fully later herein, is automatically released when a predetermined cycle of operation of the machine 20 is completed. The movements and relative positions of end 72 of clutch lever 54 and of cam gear 74 are depicted in FIGS. 4 & 5, with FIG. 4 depicting the released condition of the clutch and FIG. 5 depicting the engaged condition of the clutch.

Figure 5:
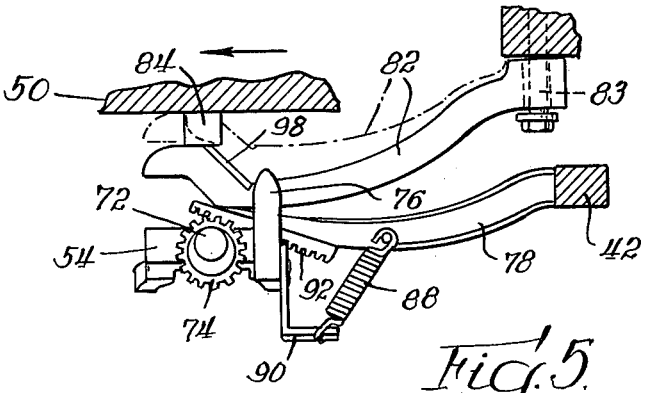
FIG. 5 is another plan view of the clutch portion similar to FIG. 4 but depicting a different operational position.

The movement of cam gear 74 between the two positions shown in FIGS. 4 & 5 — and the engagement and release of clutch plates 52 & 64 — is effected by the cooperation of a wedge shape gear or kickout release rack lever 78 (loosely pivotally mounted through a slightly undersize pin 80 to bell crank 42), a cam follower lever 82 (loosely mounted on an undersize pin 83 secured to frame 24), and a stop block or cam block 64 (formed integrally on main face cam 50).

A pair of biasing springs 88 are so mounted between release rack lever 78 and a bracket 90 mounted by suitable fasteners to clutch lever 54 as to continually mesh the rack gear teeth 92 (on rack lever 78) to cam gear 74. This is especially important when rack lever 78 and cam gear 74 are not under any other external biasing forces, as will be described later herein.

It will be understood that depression of foot pedal 38 and thus trip bar 40 causes bell crank 42 to rotate about a pin 94 in the direction of the curved arrow in FIG. 3, and thus move release rack lever 78 along a line generally indicated by the double-headed arrow in the same FIGURE. When the release rack lever 78 is fully inserted between cam gear 74 and the cam follower lever 82 (FIG. 4), the clutch 62 will be disengaged when cam block 84 contacts follower lever 82, and will be engaged during the time that cam block 84 is not in contact with follower lever 82. Because of the above-noted constant meshing or direct positive engagement of gear teeth 92 to cam gear 74, movement of release rack lever 78 from left to right (FIG. 3) — or from its position as shown in FIG. 4 to the position shown in FIG. 5 — causes cam gear 74 to rotate in an eccentric manner from a high point position (FIG. 4) to a low point position (FIG. 5). Thus, to engage clutch 62, when rack lever 78, follower lever 82, and cam block 84 assure the position shown in FIG. 4, it is necessary to depress the foot pedal 38 thereby causing rack lever 78 to slide against lever 82 to the right as viewed in FIG. 4 until a somewhat reduced lateral dimension (denoted generally by reference letter "X" in FIG. 4) of lever 78 is presented between cam gear 74 and follower lever 82 (see FIG. 5). As noted above, this linear movement of rack lever 78 causes cam gear 74 to eceentrically rotate about lever end 72 to its low point position (FIG. 5) so that the overall effective distance between the central vertical axis Y of lever end 72 and a backface 98 of follower lever 82 is reduced. That is, sufficient clearance is provided to enable lever end 72 to freely move toward main face cam 50. The movement of lever end 72 (from its position in FIG. 4 to FIG. 5) is effected by a coil spring in the clutch hub (neither shown) which normally biases the movable driven clutch plate 60 to its engaged position with the driving clutch plate 64 on pulley 46.

With release rack lever 78 moved to the right (FIG. 5), follower lever 82 (solid lines in FIG. 5) may be moved toward lever end 72 by cam block 84 without exerting any pressure on cam gear 74 and lever end 72.

Hence, cam block 84 may move past follower lever 82 without disengaging the clutch 62. As long as rack lever 78 is maintained in its right hand position (FIG. 5) — such as would be the case if the operator kept the foot pedal 38 depressed, the tying machine 20 will continue to operate and repeat its cycle of operation indefinitely.

When it is desired to stop the tying machine — such as after one full tying cycle has been completed, release rack lever 78 is caused to be moved to the left (see FIG. 4), so that when cam block 84 rotating with main cam 50 next moves into contact with the backface 98 on follower lever 82, the rise of cam block 84 will be transmitted through follower lever 82, release rack lever 78 (at a position thereof to the right of dimension X in FIG. 4 and which presents an increased lateral dimension), and cam gear 74 (rotated to its high point position, FIG. 4), thereby moving the end 72 of the forked clutch lever 54 to its clutch releasing position, whereby the driving connection to main cam 50 is interrupted and cam block 84 will remain in substantially the position shown in FIG. 4.

The movement of lever 78 to the left (FIG. 4) occurs as follows. A pair of trip return springs 100 mounted between the frame 12 and bell crank 42 are provided to cause the release rack lever 78 to be continually interposed between cam gear 84 and follower lever 82. The springs 100 are of such a magnitude that, coupled with the mechanical advantage due to the small degree of incline (approximately 14° , see FIG. 4) of wedge-shaped rack lever 78 meshed with the eccentric cam gear 74, and the fact that clutch lever 54 must rotate about pin 56 substantially to its full available extend before clutch 62 is engaged, the lever 78 is always capable of partially overcoming the force of the clutch spring (not shown) acting on clutch lever 54 whereby there is at least some separation of lever end 72 and cam gear 74 from follower lever 82 at all times. The result of this constant separation is that, except for when the foot pedal 38 has been depressed — at which time the rack lever 78 still separates cam gear 74 and follower lever 82 but to a somewhat lesser extent, the rack lever 78 is always in a condition to separate the various above-noted coacting clutch components between lever end 72 and cam block 84 so as to be operable to either cause disengagement of the clutch 62 at the next available opportunity or to maintain it in an already disengaged condition.

To further explain this point, let it be assumed that the tying machine 20 has cycled once and then is turned off (the motor 22 being de-energized) with the coacting clutch components substantially in the positions shown in FIG. 4. If perchance the pedal 38 were tripped, even though the rack lever 78 would be moved to the right of its position shown in FIG. 4, it would still remain interposed sufficiently between cam gear 74 and cam follower lever 82 — to a position to the left of the position of lever 78 in FIG. 5 but not necessarily completely returned to its position in FIG. 4 — such that the clutch 62 would not yet be engaged when the motor 22 is next energized, it being understood that the cam block 84 would still be in its position of FIG. 4 since the face cam 50 would have not moved.

It will be noted that this constant separation feature is different from prior art devices which did not have a mechanical clutch lock out because a so-called slip link — which was connected to the cycle initiating foot pedal or hand lever — had a very large wedge angle on its nose and could not separate the forked clutch lever and cam follower lever until the follower lever engaged the cam block, i.e., until a complete tying cycle was accomplished. It will also be noted that the clutch operating components of the present invention, due largely to the above-noted mechanical advantages employed, prevent any possible self-releasing of the tying machine's clutch, which was a problem inherent in prior art machines due mainly to the large nose angle formed on the so-called clutch slip link.

It will thus be appreciated that the combination of the eccentric cam gear 74, the release rack lever 78, the cam follower lever 82, and the cam block 84 cooperate to provide an inexpensive and effective automatic clutch lock out mechanism, in addition to being a smooth and gradual and substantially noiseless clutch operating mechanism, all for a package tying machine.

The previously-described loose connections of release rack lever 78 by pin 80 and cam follower lever 82 by pin 83 are provided so that the levers 78 and 82 will have some play or freedom of movement toward and away from lever end 72. It will again be noted that the biasing springs 88 are provided to keep the gear components (rack gear teeth 92 and cam gear 84) in constant mesh including such times as when no other external forces are present to mesh the same, such as when the follower lever 82 has climbed over the cam block 84 and is loosely riding the main face cam 50 (see dotted position of lever 82 in FIG. 5) during a tying cycle.

A significant feature of the present invention, at least from a practical standpoint, is that once the clutch plates 60, 64 have begun to wear, any necessary slack adjustments can be had by separating the lever 78 (against the bias of springs 88) from cam gear 74 and then further inserting lever 78 between gear 74 and lever 82, thereby effectively reducing the lateral distance the lever end 72 must travel before clutch 62 is engaged.

It is thus seen that the above-described clutch release and automatic clutch lock out mechansim is operable to eliminate the sharp mechanical noises found in prior clutch operating mechanisms and to eliminate the costly and unreliable electrical clutch lock out mechanisms of prior package tying machines.

From the foregoing it is believed that those skilled in the art will readily appreciate the unique features and advantages of the present invention over previous types of automatic clutch lock out and clutch release mechanisms for package tying machines. Further, it is to be understood that while the present invention has been described in relation to a particular preferred embodiment as set forth in the accompanying drawings and as above described, the same nevertheless is susceptible to change, variation and substitution of equivalents without departure from the spirit and scope of this invention. It is therefore intended that the present invention be unrestricted by the foregoing description and drawings, except as may appear in the following appended claims.

The embodiments of the invention in which an exclusive property or privilege is claimed are defined as follows:

1. In a clutch operating mechanism for a package tying machine of the type comprising a support frame, a motor, a drive system including a clutch coupling the motor to a main cam and to a rotatably driven twine arm for wrapping a reach of twine about a package, and a trip mechanism for initiating a tying cycle; the clutch operating mechanism including a clutch lever for controlling the operation of the clutch and a follower lever interposed between the main cam and the clutch lever to transmit motion therebetween, the improvement comprising: a toothed cam gear rotatably journalled on the clutch lever, and a release lever interposed between said rotatable cam gear and the follower lever and operable to transmit motion to the clutch lever for controlling operation of the clutch, said release lever being responsively connected to the trip mechanism and having rack gear teeth formed thereon in meshing relation to the teeth on the cam gear, whereby initiation of the trip mechanism causes said release lever to translate and rotatably drive the cam gear to effect clutch engaging movement of the clutch lever.

2. The clutch operating mechanism of claim 1, including biasing means operable to insure constant meshing of the gear teeth on the release lever and the cam gear.

3. The clutch operating mechanism of claim 1, wherein said release lever has a tapered or wedge-shaped portion arranged so that said appropriate movement thereof effects a reduced lateral distance between the cam gear and the follower lever thereby to increase clutch lever movement.

4. A package tying machine comprising a frame; a table upon which a package is tied; a source of twine; power operated means for wrapping and tying the twine about a package, said power operated means including a rotatable face cam; a clutch; a trip mechanism for initiating a tying operation; and a clutch operating mechanism including a clutch lever operable when moved to engage said clutch, a cam follower lever interposed between said face cam and said clutch lever and operable to transmit motion therebetween, a cam means eccentrically journalled on said clutch lever, and a release means responsively connected to said trip mechanism and interposed between said follower lever and said cam means, and having driving engagement with the latter whereby movement of said release means in one direction effects rotation of said cam means to operate said clutch lever to engage said clutch.

5. The invention of claim 4, wherein said release means comprises a wedge-shaped reciprocably movable release lever having gear means drivingly engageable with said cam means.

6. A clutch operating mechanism for a package tying machine operable to controllably interconnect the tying machine's main drive cam and clutch, comprising in combination:

a clutch lever adapted to operate the clutch; cam means eccentrically journalled on said clutch lever and adapted to effect clutch engaging movement of said clutch lever when rotated;

a cam follower means interposed between said cam means and the tying machine's main drive cam;

and a release means interposed between said cam means and said cam follower means and characterized by means operable to positively engage said cam means and to maintain said cam means and cam follower lever in separated positions, whereby operation of said release means effects rotation of said cam means to move said clutch lever to clutch engaging position.

7. A clutch operating and automatic clutch lock out mechanism for a package tying machine of the type having a motor, a primary shaft supporting a clutch, a secondary shaft supporting a rotatable cam means, and drive means connecting the motor with said primary and secondary shafts, comprising in combination:

a clutch control member positioned intermediate said primary shaft and secondary shafts and operable when moved to control engagement and release of the clutch;

clutch cam means mounted on said clutch control member for eccentric rotation adjacent said secondary shaft and operable when rotated to vary the clutch operating movements of said clutch control member in accordance with the rotational movement thereof;

a cam follower member interposed between the rotatable cam means and said clutch cam means and adapted to transmit motion therebetween;

linearly-translatable release means interposed between said cam follower member and said clutch cam means and adapted when translated to positively engage and rotate the latter, said release means being operable to maintain separation of said clutch cam means and said cam follower member throughout its translation movements; and biasing means operable to maintain said release means in interposed relation between said cam follower member and said clutch cam means;

whereby when the tying machine's motor is energized sufficient translation of said release means in a first direction effects clutch engagement, and when the motor is de-energized said biased translation of said release means in a second direction between said cam follower member and said clutch cam means prevents inadvertent clutch engagement due to translation of said release means in said first direction.

8. The clutch operating and lock out mechanism of claim 7, wherein engageable gear means are provided on both said release means and said clutch cam means to provide said positive engagement therebetween.

9. In combination:

a drive motor;

a motor-driven cam means having a projecting stop means formed thereon;

means coupling said motor to said cam means including a clutch means and a drive means;

and a clutch operating means including a follower lever operable to engage said cam means and transmit lateral motion when engaged by said stop means, a clutch lever mounted adjacent said clutch means and adapted to control engagement of the same, an eccentrically rotatable clutch cam means journalled on said clutch lever and operable when rotated to move the latter to effect control of said control means, and wedge-shaped release lever means interposed between said follower lever and said clutch cam means and adapted to transmit motion therebetween, said release lever further being positively engaged with said clutch cam means and operable when linearly translated to rotate the same while maintaining separation between said clutch cam means and said follower lever; whereby when clutch engagement is desired, sufficient linear translation of said release lever effects rotation of said clutch cam means to produce clutch lever movement sufficient to engage said clutch means, thereby enabling said motor-driven cam means to move until said stop means engages said follower lever and motion is transmitted through said follower lever, release lever, and clutch cam gear to move said clutch lever and disengage the clutch.

10. The invention of claim 9, wherein said clutch cam means has spur gear teeth formed thereon and said release lever has rack gear teeth formed on its face confronting said clutch cam means whereby the meshing thereof provides said positive engagement therebetween.

11. The invention of claim 10, wherein said release lever is wedge-shaped and operable to both rotate said clutch cam means and to further separate the latter and said follower lever when linearly translated further therebetween.

* * * * *